US006963329B2

(12) United States Patent
Lee

(10) Patent No.: US 6,963,329 B2
(45) Date of Patent: Nov. 8, 2005

(54) PORTABLE COMPUTER SYSTEM AND CONTROLLING METHOD THEREOF

(75) Inventor: Chang-Hum Lee, Anyang (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 341 days.

(21) Appl. No.: 10/078,348

(22) Filed: Feb. 21, 2002

(65) Prior Publication Data

US 2003/0016204 A1 Jan. 23, 2003

(30) Foreign Application Priority Data

Jul. 23, 2001 (KR) ..... 2001-44211

(51) Int. Cl.[7] ..... G09G 3/36
(52) U.S. Cl. ..... 345/102; 349/61
(58) Field of Search ..... 345/61–71, 77, 345/102; 349/61, 69, 71; 315/169.1–169.4

(56) References Cited

U.S. PATENT DOCUMENTS

| | | | | | |
|---|---|---|---|---|---|
| 4,760,389 | A | * | 7/1988 | Aoki et al. | 345/102 |
| 5,153,756 | A | * | 10/1992 | Ike | 349/116 |
| 5,157,525 | A | * | 10/1992 | Eaton et al. | 345/87 |
| 5,162,785 | A | * | 11/1992 | Fagard | 345/87 |
| 5,315,695 | A | * | 5/1994 | Saito et al. | 345/102 |
| 5,751,118 | A | * | 5/1998 | Mortimer | 315/291 |
| 5,786,801 | A | * | 7/1998 | Ichise | 345/102 |
| 5,818,172 | A | * | 10/1998 | Lee | 315/86 |
| 5,818,553 | A | * | 10/1998 | Koenck et al. | 349/61 |
| 5,828,351 | A | * | 10/1998 | Wu | 345/11 |
| 5,854,617 | A | | 12/1998 | Lee et al. | |
| 5,952,992 | A | * | 9/1999 | Helms | 345/102 |
| 6,069,449 | A | | 5/2000 | Murakami | |
| 6,297,861 | B1 | * | 10/2001 | Jo | 348/806 |
| 2001/0008395 | A1 | * | 7/2001 | Yamamoto et al. | 345/102 |

FOREIGN PATENT DOCUMENTS

| | | | | |
|---|---|---|---|---|
| JP | 5-165424 | | 7/1993 | |
| JP | 5-276656 | | 10/1993 | |
| JP | 6-34946 | | 2/1994 | |
| JP | 06034946 | A * | 2/1994 | G02F/1/133 |
| JP | 7-120719 | | 5/1995 | |
| JP | 7-211476 | | 8/1995 | |
| JP | 07211476 | A * | 8/1995 | H05B/41/29 |
| JP | 8-213182 | | 8/1996 | |
| JP | 9-80377 | | 3/1997 | |
| JP | 9-230304 | | 9/1997 | |
| JP | 10-148808 | | 6/1998 | |
| JP | 11-97196 | | 4/1999 | |
| KR | 1998-26702 | | 8/1998 | |
| KR | 1999-84477 | | 12/1999 | |

* cited by examiner

*Primary Examiner*—Kent Chang
(74) *Attorney, Agent, or Firm*—Robert E. Bushnell, Esq.

(57) ABSTRACT

A portable computer system comprises a main body and an LCD apparatus having an LCD panel and a back light for illuminating the LCD panel. The system further comprises: a DC/AC inverter for supplying AC power to the back light; a contrast sensing part for sensing contrast of a video signal displayed on the LCD panel; a DC converter for converting a PWM signal outputted from the contrast sensing part into a DC signal; a voltage controller causing the DC signal from the DC converter to be appropriate for an operating voltage of the DC/AC inverter so as to supply the operating voltage to the DC/AC inverter; and a controller for sensing the operating voltage of the DC/AC inverter, and for controlling the voltage controller on the basis of the operating voltage. With this configuration, the brightness of a back light can be automatically controlled according to a contrast sensed by a contrast sensing part regardless of the input impedance of the inverter.

20 Claims, 3 Drawing Sheets

PORTABLE COMPUTER SYSTEM AND CONTROLLING METHOD THEREOF

CLAIM OF PRIORITY

This application makes reference to, incorporates the same herein, and claims all benefits accruing under 35 U.S.C. §119 for an application for PORTABLE COMPUTER AND CONTROLLING METHOD THEREOF earlier filed in the Korean Industrial Property Office on 23 Jul. 2001, and there duly assigned Ser. No. 44211/2001 by that Office.

BACKGROUND OF THE INVENTION

1. Technical Field

The present invention relates, in general, to a portable computer system and a controlling method thereof and, more particularly, to a portable computer system and controlling method in which an LCD back light is automatically controlled.

2. Related Art

Generally, a portable computer system comprises a main body and a display apparatus. The main body includes hardware components such as a hard disk, memory cards, etc., a micom (micro control unit), and a power supplying unit for supplying electric power to the main body and the display apparatus. The display apparatus includes a liquid crystal display (LCD) panel rotatably joined to the main body by a hinge and displaying a picture thereon, and a back light illuminating the LCD panel.

The portable computer system is provided with a volume controller or a hot key controlling the brightness of the back light so as to control the brightness of a screen.

However, in the portable computer system, there may be a waste of electric power because the back light has a constant brightness regardless of the contrast of a video signal, and it is inconvenient for a user to control the brightness of the back light according to a change in contrast.

Thus, a further portable computer system has been developed, and is equipped with a smart module for sensing the contrast of the video signal displayed on the LCD panel, and for automatically controlling the brightness of the back light according to the contrast sensed by the smart module.

In the portable computer system equipped with the smart module, if a user sets the back light to a maximum state, the brightness of the back light is automatically controlled within the range of a minimum value through a maximum value according to the contrast of the video signal. If the user sets the back light to a typical state, the brightness of the back light is automatically controlled within the range of a minimum value through a typical value according to the contrast of the video signal.

However, in the portable computer system equipped with the smart module, a micom outputting a control signal for controlling the back light according to a user's control input is indirectly connected to an inverter via a direct current (DC) converter. Further, the control signal outputted from the micom is different from a control signal outputted from the smart module in a voltage range. Therefore, the control signal of the smart module may be not within the limits of an operating voltage of the inverter. In other words, the output impedance of the smart module may be different from the input impedance of the inverter.

Further, when a main body, in which the operating voltage of the inverter is set based on the voltage range of the smart module, is connected to a general LCD apparatus which is not equipped with a smart module, a voltage matching circuit is additionally required. Thus, the manufacturing process gets complicated and the cost of production increases.

Moreover, in the portable computer system equipped with the smart module, even if the contrast is changed rapidly, the brightness of the back light changes slowly.

The following are considered to be generally pertinent to the present invention but are burdened by the disadvantages set forth above: Korean Patent Publication No. 1998-26702 to Kyung-Soo Lee, entitled BRIGHTNESS CONTROL APPARATUS IN A LCD, published on 5 Aug. 1998; Korean Patent Publication No. 1999-84477 to Chang-Soo Shon, entitled METHOD AND CIRCUIT OF RIVING A BACK LIGHT IN A PORTABLE APPARATUS, published on 6 Dec. 1999; Japanese Patent Publication No. 5-165424 to Yano, entitled INVERTER FOR LCD BACK LIGHT, published on 2 Jul. 1993; Japanese Patent Publication No. 5-276656 to Hirayama et al., entitled LIQUID CRYSTAL DISPLAY, published on 22 Oct. 1993; Japanese Patent Publication No. 6-034946 to Shibata, entitled BACK LIGHT UNIT, published on 10 Feb. 1994; Japanese Patent Publication No. 7-120719 to Kanai, entitled LIGHT CONTROLLABLE DEVICE, published on 12 May 1995; Japanese Patent Publication No. 7-211476 to Nomoto, entitled LIGHTING CIRCUIT FOR FLUORESCENT LAMP, published on 11 Aug. 1995; Japanese Patent Publication No. 8-213182 to Lee, entitled DRIVING CIRCUIT OF REAR SURFACE LIGHT SOURCE OF LIQUID CRYSTAL DISPLAY ELEMENT, published on 20 Aug. 1996; Japanese Patent Publication No. 9-230304 to Iijima, entitled LIQUID CRYSTAL BACK LIGHT DRIVE CIRCUIT, published on 5 Sep. 1997; Japanese Patent Publication No. 9-080377 to Shikanuma, entitled DIMMER FOR IMAGE DISPLAY DEVICE, published on 28 Mar. 1997; Japanese Patent Publication No. 10-148808 to Kohata, entitled BACKLIGHT DEVICE AND LIQUID CRYSTAL DISPLAY DEVICE USING IT; Japanese Patent Publication No. 11-097196 to Nagai, entitled DIMMING DEVICE FOR LIQUID CRYSTAL DISPLAY, published on 9 Apr. 1999; U.S. Pat. No. 5,854,617 to Lee et al., entitled CIRCUIT AND A METHOD FOR CONTROLLING A BACKLIGHT OF A LIQUID CRYSTAL DISPLAY IN A PORTABLE COMPUTER, issued on Dec. 29, 1998; and U.S. Pat. No. 6,069,449 to Murakami, entitled BACKLIGHT CONTROL DEVICE FOR AN LCD, issued on May 30, 2000.

SUMMARY OF THE INVENTION

The present invention has been developed with the above-described shortcomings and the needs of the user in mind. One object of the present invention is to provide a portable computer system and a controlling method in which the brightness of a back light is automatically controlled in accordance with a contrast sensed by a contrast sensing part regardless of an input impedance of an inverter.

Another object of the present invention is to provide a portable computer system and a controlling method in which an additional voltage matching circuit is not needed when a general LCD apparatus which is not equipped with a contrast sensing part is connected to a main body in which an operating voltage of an inverter is set on the basis of a voltage range of the contrast sensing part.

Still another object of the present invention is to provide a portable computer system and a controlling method in which a user can optionally use a back light automatic control function.

These and other objects of the present invention are accomplished by the provision of a portable computer system comprising: a main body to which a power supplying unit is connected; an LCD apparatus including an LCD panel operated by electric power supplied by the power supplying unit; a back light illuminating the LCD panel; a direct current to alternating current (DC/AC) inverter for supplying alternating current (AC) power to the back light; a contrast sensing part for sensing the contrast of a video signal displayed on the LCD panel; a DC converter for converting a pulse width modulation (PWM) signal outputted by the contrast sensing part into a DC signal; a voltage controller provided between the DC converter and the DC/AC inverter for allowing the DC signal of the DC converter to be identical with an operating voltage of the DC/AC inverter, and for supplying the operating voltage to the DC/AC inverter; and a controller connected in series with the DC/AC inverter for sensing the operating voltage of the DC/AC inverter, and for controlling the voltage controller on the basis of the operating voltage.

Herein, the controller is directly connected to the DC/AC inverter, and the contrast sensing part is connected to the DC/AC inverter via the DC converter and the voltage controller.

The portable computer system further comprises a back light manual selection part for suspending back light automatic control in accordance with the contrast sensing part, wherein the controller turns off the voltage controller when the back light manual selection part is selected for manual control. Herein, the back light manual selection part is selected through a keyboard unit provided on the main body.

According to another aspect of the present invention, the above and other objects are also achieved by the provision of a method for controlling a portable computer system which comprises a main body to which a power supplying unit is connected, and an LCD apparatus including an LCD panel operated by electric power supplied by the power supplying unit, a back light illuminating the LCD panel, and a contrast sensing part. The method comprises the steps of: sensing an operating voltage of a DC/AC inverter supplying an AC voltage to the back light; converting a back light control signal outputted from the contrast sensing part into a DC signal; and controlling the DC voltage to have an intensity for operating the DC/AC inverter so as to supply a DC voltage to the DC/AC inverter.

The method further comprises the steps of selecting a back light manual control function, and suspending a back light automatic control in accordance with a contrast sensing part so as to allow a user to manually control the back light when the back light manual control function is selected.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE PREFERRED EMBODIMENT

The present invention will be described in more detail with reference to the accompanying drawings.

Figure 1:
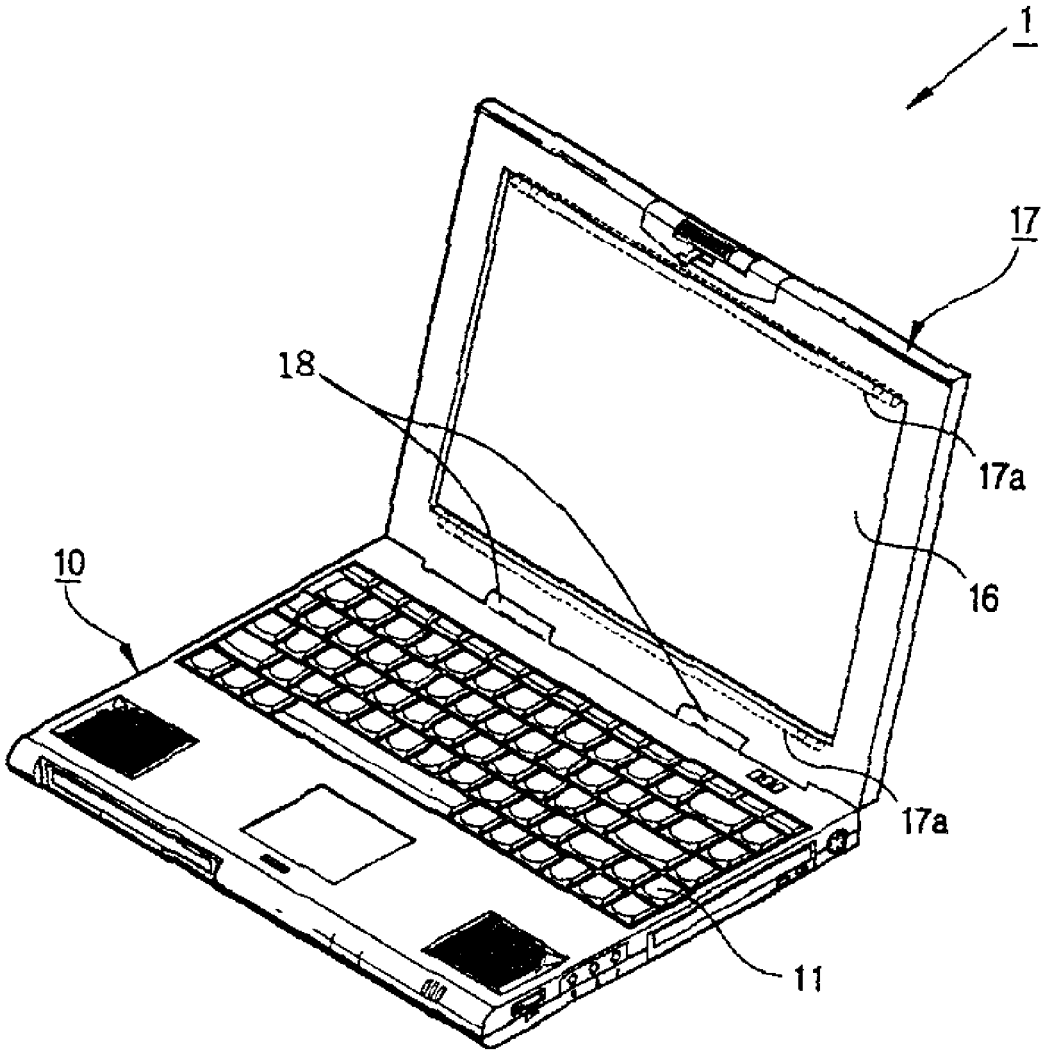
FIG. 1 is a perspective view of a portable computer system according to the present invention.

FIG. 1 is a perspective view of a portable computer system according to the present invention. As shown in FIG. 1, a portable computer system 1 comprises a main body 10 having a plurality of hardware components such as a central processing unit, a video card, etc. (not shown in FIG. 1), and an LCD apparatus 17 rotatably joined to the main body 10 by a hinge or hinges 18, and displaying a picture thereon according to a video signal outputted from the video card. Further, the main body 10 includes a keyboard unit or keyboard 11 through which a user inputs data or control commands.

The LCD apparatus 17 includes an LCD panel 16, a back light (cathode fluorescent lamp) 17*a* installed at upper and lower parts of the LCD panel 16 and illuminating the LCD panel 16 so as to control the brightness of a picture, a video unit (not shown) for processing a video signal outputted by the video card of the main body 10, and a contrast sensing part 17*b* (see FIG. 2) for sensing the contrast of the video signal processed by the video unit and displayed on the LCD panel 16, and for outputting a corresponding pulse width modulations (PWM) signal.

Figure 2:
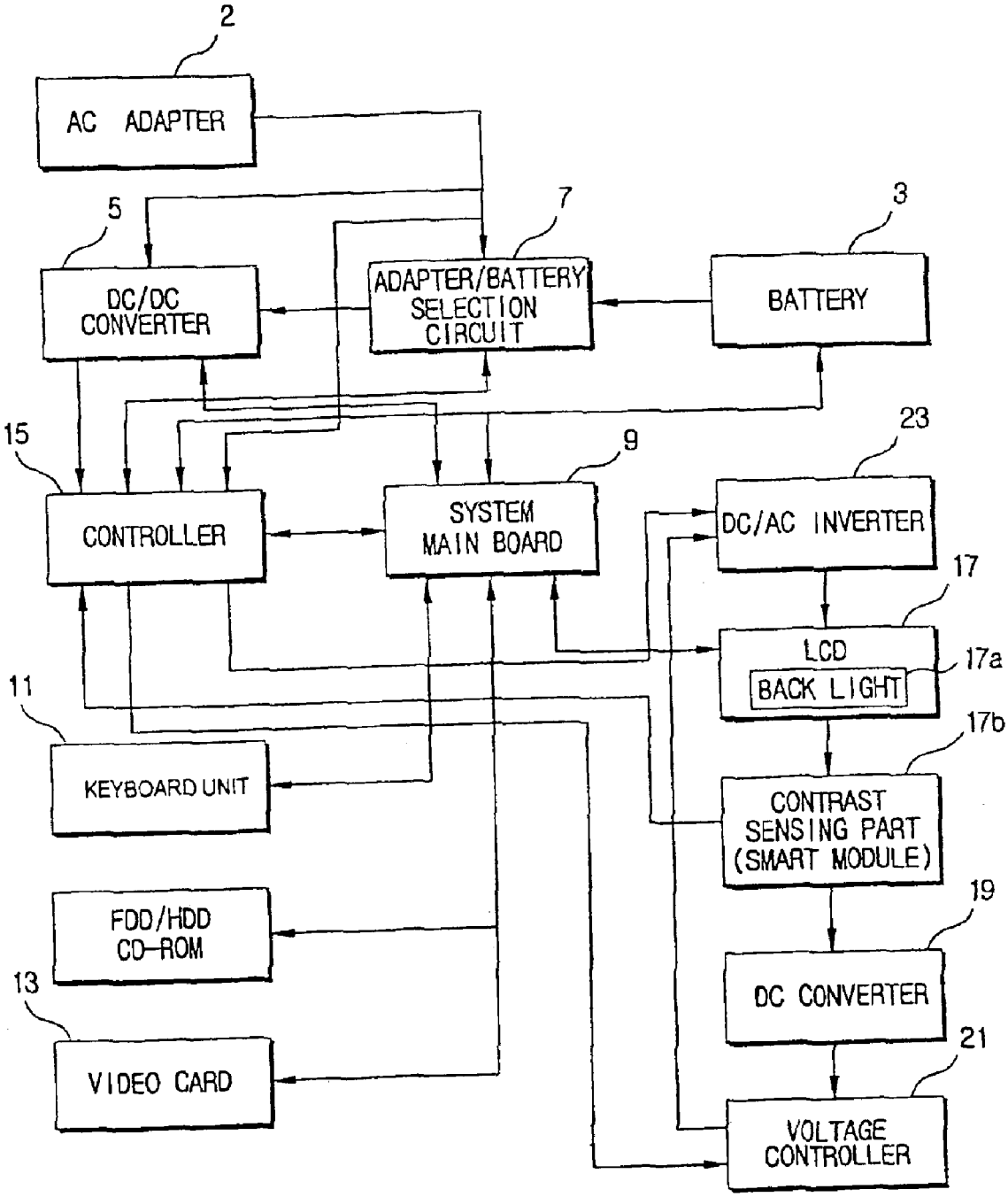
FIG. 2 is a control block diagram of the portable computer system according to the present invention.

FIG. 2 is a control block diagram of the portable computer system according to the present invention. The main body 10 of FIG. 1 includes, as shown in FIG. 2, a DC converter 19 for converting the PWM signal outputted by the contrast sensing part 17*b* into a DC signal, a voltage controller 21 for controlling the DC signal outputted by the DC converter 19 so that it has an intensity for operating the DC/AC inverter 23, a DC/AC inverter 23 for converting the output signal from voltage controller 21 into an AC signal and for supplying the AC signal to the back light 17*a* of LCD 17, and a controller 15 directly connected to the DC/AC inverter 23 and controlling the voltage controller 21 by sensing an operating voltage of the DC/AC inverter 23.

Herein, the DC/AC inverter 23 outputs a voltage of several volts, and the brightness of the back light 17*a* is automatically controlled according to the intensity of an output voltage of DC/AC inverter 23. Further, the controller 15 senses the operating voltage of the DC/AC inverter 23, and controls the voltage controller 21 so as to boost the voltage of the signal outputted from the contrast sensing part 17*b* when the voltage intensity of the signal sensed by the contrast sensing part 17*b* is not enough to operate the DC/AC inverter 23.

On the other hand, the back light 17*a* is manually controlled through a hot key provided at the keyboard unit 11, or through a volume controller provided at a side of the main body 10 for adjusting the brightness thereof. Thus, the controller 15 outputs a control signal for controlling the brightness of the back light 17*a* to the DC/AC inverter 23 according to setting of the hot key or the volume controller.

In the main body 10 according to the present invention, a back light manual selection part (not shown) is provided for selecting manual or automatic control of the back light 17*a* by means of the contrast sensing part 17*b* as necessary. Herein, a hot key or another button may be employed as the back light manual selection part.

When a user selects the back light manual selection part for manual control of the back light 17*a*, the controller 15 turns off the voltage controller 21 so as to suspend the operation of the contrast sensing part 17*b*.

As shown in FIG. 2, a control circuit of the portable computer system according to the present invention comprises a power supplying unit which includes a battery 3 or an AC adapter 2, a selection circuit 7 for selecting the battery 3 or the adapter 2, a DC/DC converter 5 for converting the supplied electric power into operating voltages adaptable to each device, a system main board 9 on which the video card 13 is mounted and which controls each device. The LCD apparatus 17 displays a video signal outputted from the video card 13. The contrast sensing part 17*b* is provided in the LCD apparatus 17 and senses the contrast of the video signal. The keyboard unit 11 is used to manually set the brightness of the back light 17*a* as necessary, and the controller 15 outputs control signals to every hardware component through the system main board 9.

Further, the control circuit of the portable main body includes the DC converter 19 for converting the PWM signal outputted from the contrast sensing part 17*b* into a DC signal, and the voltage controller 21 for controlling the DC signal from the DC converter 19 so that it has an intensity for operating the DC/AC inverter 23.

The contrast sensing part 17*b* senses the contrast of a video signal which is processed by the video unit of the LCD apparatus 17, and outputs a brightness control signal (sensed contrast signal) in the form of a PWM signal. The PWM brightness control signal for controlling the back light 17*a* is inputted to the DC converter 19, and is then converted into a DC brightness control signal. The DC brightness control signal is then amplified or diminished by the voltage controller 21 so as to operate the DC/AC inverter 23.

A back light control signal selected by a user through the controller 15 and the brightness control signal outputted from the voltage controller 21 are inputted to the DC/AC inverter 23 in parallel. If the brightness of the back light 17*a* is set to a maximum state through the keyboard unit 11, the brightness of the back light 17*a* is automatically controlled within the range of a minimum value to a maximum value according to the contrast sensing part 17*b*. Further, if the brightness of the back light 17*a* is set to a typical state, the brightness of the back light 17*a* is automatically controlled within the range of a minimum value to a typical value according to the contrast sensing part 17*b*.

Figure 3:
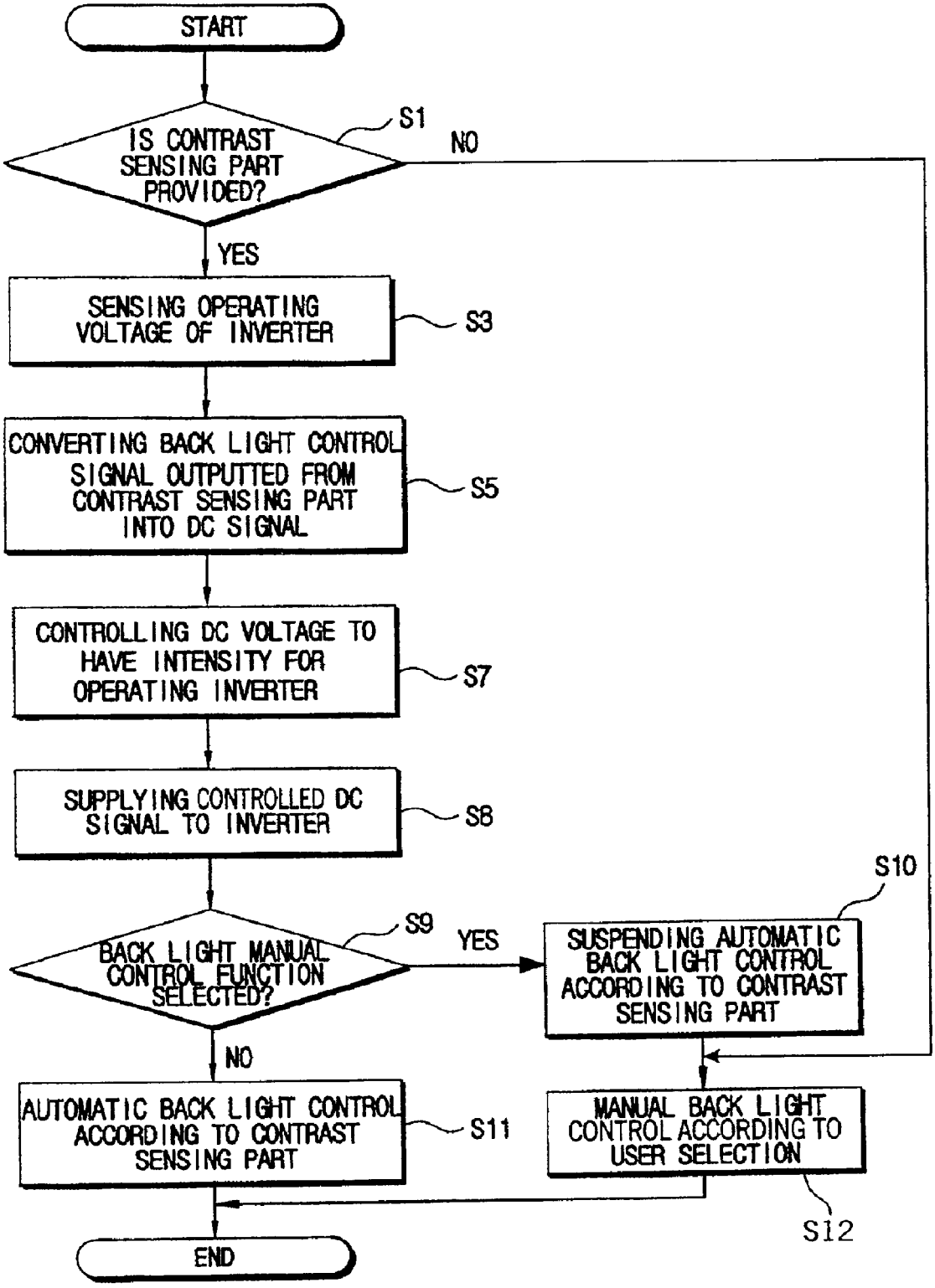
FIG. 3 is a control flow chart for controlling the portable computer system according to the present invention.

FIG. 3 is a control flowchart for controlling the portable computer system according to the present invention. As shown in FIG. 3, the control process of the portable computer system is as follows. The controller 15 determines whether or not the contrast sensing part 17*b* is provided in the LCD apparatus 17 (S1). If the contrast sensing part 17*b* is provided in the LCD apparatus, the controller 15 senses the operating voltage of the DC/AC inverter 23 (S3). Steps S1 and S3 indicate that the operating voltage of the DC/AC inverter 23 is set when the main body starts to operate. If the contrast sensing part 17*b* outputs a back light control signal by sensing contrast of a video signal, the DC converter 19 converts the back light control signal into a DC signal (S5). The voltage controller 21 adjusts the back light control signal converted into a DC signal so that it has an intensity appropriate for the operating voltage of the DC/AC inverter 23 (S7), and outputs the adjusted DC signal to the DC/AC inverter 23 (S8). Then, the DC/AC inverter 23 converts the inputted DC signal into an AC signal, and supplies the AC signal to the back light 17*a*, thereby controlling the brightness of the back light 17*a*.

When a user selects the back light manual control function (S9), the controller 15 turns off (disables) the voltage controller 21 so as to stop the automatic control signal of the contrast sensing part 17*b* from being applied to the DC/AC inverter 23 (S10), and then the user adjusts the back light 17*a* through the keyboard unit 11 as necessary (S12). On the other hand, when the user does not select the back light manual control function (S9), automatic back light is controlled according to the contrast sensing part 17*b* (S11). Finally, when the contrast sensing part 17*b* is not provided (S1), brightness of the back light 17*a* is controlled only by manual control because only the back light control signal from the controller 15 is applied to the DC/AC inverter 23 according to the user's selection (S12).

With this configuration, the brightness of the back light 17*a* can be automatically controlled within the range of a back light brightness set by a user according to contrast sensed by the contrast sensing part 17*b*. Further, in the portable computer system comprising the LCD apparatus equipped with the contrast sensing part 17*b*, impedance of the controller 15 is matched to impedance of the DC/AC inverter 23 by directly connecting the controller 15 to the DC/AC inverter 23, and by connecting the contrast sensing part 17*b* to the DC/AC inverter 23 via the DC converter 19 and the voltage controller 21, so that an additional voltage matching circuit is not needed.

Moreover, when a user selects the back light manual control function, automatic control according to the contrast sensing part 17*b* is suspended, thereby allowing the user to manually adjust the back light 17*a*.

As described above, according to the present invention, the brightness of the back light can be automatically controlled according to the contrast sensed by a contrast sensing part regardless of the input impedance of the inverter. Furthermore, an additional voltage matching circuit is not needed when a general LCD apparatus not equipped with a contrast sensing part is connected to the main body in which an operating voltage of an inverter is set on the basis of a voltage range of the contrast sensing part. Moreover, the user can optionally use a back light automatic control function.

Although the preferred embodiments of the present invention have been described, it will be understood by those skilled in the art that the present invention should not be limited to the described preferred embodiment. Rather, various changes and modifications can be made within the spirit and scope of the present invention, as defined by the following claims.

What is claimed is:

1. A portable computer system which includes a main body, a power supplying unit, and a liquid crystal display (LCD) apparatus having an LCD panel which is operated by electric power supplied by the power supplying unit and a back light which illuminates the LCD panel, said system further comprising:

a direct current alternating current (DC/AC) inverter for supplying AC power to the back light;

a contrast sensing part for sensing contrast of a video signal displayed on the LCD panel and outputting a pulse width modulation (PWM) signal;

a DC converter for converting the PWM signal from the contrast sensing part into a DC signal;

a voltage controller provided between an output of the DC converter and an input of the DC/AC inverter for providing the DC signal from the DC converter as an operating voltage to the DC/AC inverter; and a controller connected in series with the DC/AC inverter for sensing the operating voltage of the DC/AC inverter, and for controlling the voltage controller on the basis of the operating voltage of the DC/AC inverter.

2. The portable computer system according to claim 1, wherein an output of the controller is directly connected to another input of the DC/AC inverter, and the contrast sensing part is connected to the DC/AC inverter via the DC converter and the voltage controller.

3. The portable computer system according to claim 1, further comprising a back light manual selection part operable for suspending a back light automatic control function, and wherein the controller turns off the voltage controller when the back light manual selection part is operated to suspend the back light automatic control function.

4. The portable computer system according to claim 3, wherein the back light manual selection part is included in a keyboard unit provided in the main body.

5. A method of controlling a portable computer system which includes a main body to which a power supplying unit is connected, and an LCD apparatus having an LCD panel operated by electric power supplied by the power supplying unit, a back light for illuminating the LCD panel, and a contrast sensing part connected to the LCD panel, said method comprising the steps of:

sensing contrast of a video signal displayed on the LCD panel;

outputting a pulse width modulation (PWM) signal from the contrast sensing part in response to the sensing step;

converting the pulse width modulation (PWM) signal into a DC signal;

controlling the DC signal to have an intensity for operating a DC/AC inverter which supplies an AC voltage to the back light; and supplying the controlled DC signal as a DC operating voltage to the DC/AC inverter.

6. The method according to claim 5, further comprising the steps of:

selecting a back light manual control function; and suspending a back light automatic control function so as to allow a user to manually control the back light when the back light manual control function is selected.

7. The method according to claim 6, further comprising the step, prior to the sensing step, of determining whether the contrast sensing part is provided, and suspending the back light automatic control function so as to allow the user to manually control the back light when the contrast sensing part is not provided.

8. The method according to claim 7, wherein a back light automatic control function is carried out based on the step of sensing the contrast of the video signal displayed on the LCD panel, the sensing step being carried out by the contrast sensing part.

9. The method according to claim 6, wherein a back light automatic control function is carried out based on the step of sensing the contrast of the video signal displayed on the LCD panel, the sensing step being carried out by the contrast sensing part.

10. The method according to claim 5, further comprising the step, prior to the sensing step, of determining whether the contrast sensing part is provided, and suspending a back light automatic control function so as to allow a user to manually control the back light when the contrast sensing part is not provided.

11. The method according to claim 10, wherein a back light automatic control function is carried out based on the step of sensing the contrast of the video signal displayed on the LCD panel, the sensing step being carried out by the contrast sensing part.

12. The method according to claim 5, wherein a back light automatic control function is carried out based on the step of sensing the contrast of the video signal displayed on the LCD panel, the sensing step being carried out by the contrast sensing part.

13. A portable computer system having a liquid crystal display (LCD) and a back light illuminating the LCD panel, said system further comprising:

direct current to alternating current (DC/AC) inverter means for supplying AC power to the back light;

contrast sensing means for sensing a contrast of a video signal displayed on the LCD panel and outputting a pulse width modulation (PWM) signal;

DC converter means for converting the PWM signal outputted by the contrast sensing means into a DC signal; and voltage controller means disposed between an output of the DC converter means and an input of the DC/AC inverter means for controlling the DC signal from the DC converter means so that it has an intensity of an operating voltage for the DC/AC inverter means, and for supplying the controlled DC signal to the DC/AC inverter means.

14. The portable computer system according to claim 13, further comprising controller means connected to the DC/AC inverter means for sensing the operating voltage of the DC/AC inverter means, and for controlling the voltage controller means on the basis of the sensed operating voltage.

15. The portable computer system according to claim 14, wherein an output of the controller means is directly connected to another input of the DC/AC inverter means, and the contrast sensing means is connected to the DC/AC inverter means via the DC converter means and the voltage controller means.

16. The portable computer system according to claim 14, further comprising back light selection means operable by a user for selecting manual control of the back light and for suspending automatic control of the back light.

17. The portable computer system according to claim 16, wherein the back light selection means comprises a keyboard unit of the portable computer system.

18. The portable computer system according to claim 16, wherein the controller means turns off the voltage controller means when the user operates the back light selection means to select the manual control of the back light.

19. The portable computer system according to claim 13, further comprising back light selection means operable by a user for selecting manual control of the back light and for suspending automatic control of the back light.

20. The portable computer system according to claim 19, wherein the back light selection means comprises a keyboard unit of the portable computer system.

* * * * *